US007460808B2

(12) United States Patent
Okada

(10) Patent No.: US 7,460,808 B2
(45) Date of Patent: Dec. 2, 2008

(54) IMAGE FORMING APPARATUS AND POWER SUPPLY CONTROL METHOD

(75) Inventor: Norikazu Okada, Kanagawa (JP)

(73) Assignee: Ricoh Company Limited, Tokyo (JP)

( * ) Notice: Subject to any disclaimer, the term of this patent is extended or adjusted under 35 U.S.C. 154(b) by 167 days.

(21) Appl. No.: 11/311,294

(22) Filed: Dec. 20, 2005

(65) Prior Publication Data

US 2006/0159482 A1 Jul. 20, 2006

(30) Foreign Application Priority Data

Dec. 24, 2004 (JP) ..... 2004-374961

(51) Int. Cl.
*G03G 15/00* (2006.01)

(52) U.S. Cl. ..... 399/88; 399/90

(58) Field of Classification Search ..... 399/37, 399/88, 90, 107

See application file for complete search history.

(56) References Cited

U.S. PATENT DOCUMENTS

| | | | | |
|---|---|---|---|---|
| 5,710,959 | A | 1/1998 | Hirooka et al. | |
| 2002/0154919 | A1 * | 10/2002 | Nakaya | 399/69 |

FOREIGN PATENT DOCUMENTS

| | | |
|---|---|---|
| JP | 1-157668 | 6/1989 |
| JP | 6-113089 | 4/1994 |
| JP | 7-245682 | 9/1995 |
| JP | 9-27909 | 1/1997 |
| JP | 9-172525 | 6/1997 |
| JP | 9-200449 | 7/1997 |
| JP | 9-212042 | 8/1997 |
| JP | 9-298628 | 11/1997 |
| JP | 2946520 | 7/1999 |
| JP | 2000-326589 | 11/2000 |
| JP | 2001-86341 | 3/2001 |
| JP | 2002-345148 | 11/2002 |
| JP | 2004-176732 | 6/2004 |
| JP | 3625962 | 12/2004 |
| JP | 3640287 | 1/2005 |

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus includes a cover, a switch that opens or closes in conjunction with the cover, a load unit, a load power supply device that supplies power to the load unit, a relay that passes power from the load power supply device to the load unit in conjunction with the switch, and a controller that detects opening or closing of the switch and controls the load power supply device according to a detection result. When opening of the switch is detected, the load power supply device is controlled to interrupt supplying power to the load unit until closing of the switch is detected.

20 Claims, 11 Drawing Sheets

IMAGE FORMING APPARATUS AND POWER SUPPLY CONTROL METHOD

CROSS-REFERENCE TO RELATED APPLICATIONS

This application is based upon and claims the benefit of priority from Japanese Patent Application No. 2004-374961, filed Dec. 24, 2004, the entire contents of which are incorporated herein by reference.

BACKGROUND OF THE INVENTION

1. Field of the Invention

The present invention relates to a technology for controlling power supply, and more particularly for suppressing a surge current in an image forming apparatus having an interlock switch.

2. Description of the Related Art

Safety standards demand that an interlock circuit be provided in image forming apparatuses to prevent harm on a human body. For example, when an operator opens the front door of an image forming apparatus, motors or generators in the image forming apparatus are turned off. As a result, the operator can safely touch, handle, or repair the internal parts of the image forming apparatus. For example, when the operator opens the front door to take care of a paper jam while the power is on, control is provided so that the load driving voltage is not applied to the motors. The temperature and voltage are also prevented from increasing in this state, thereby avoiding an unexpected accident.

To realize this configuration, a power supply line to be opened or closed as an interlock circuit is wired to the front cover of the machine, and the power supply line is turned on and off with a switch for turning on and off the circuit based on a front-cover opening and closing mechanism. However, according to this method, when the load to be interrupted as the interlock circuit is a large current, the wire through which this large current flows needs to be arranged up to the front cover. This is not desirable from the viewpoint of suppressing electromagnetic radiation noise. Because of the large current, the harness of the power supply line needs to be thick. This thick harness is usually wired from the DC power supply device, which is fitted to a back lower part of the machine, to the front cover of the machine. An extra cost is required for this thick and long harness.

When the current that flows through the interlock circuit is 16 amperes, for example, at least three switches are necessary assuming that a rated current of a switch generally used is 6 amperes (6 (amperes)×3=18 (amperes)). However, when the current of 16 amperes flows at the rated current 18 amperes of the switch contact, there is little margin, and distribution of the load becomes difficult. Therefore, four switches may be necessary instead of three switches, taking margin into account. When the front cover is fitted to the left and the right sides of the machine, the number of switches fitted to the front covers becomes eight (4×2=8). However, in reality, a switch exclusively used for a laser power supply line, and a cover open/close detection switch are also necessary. Consequently, 12 switches are necessary in total (8+2(for laser)+2 (for open/close detection)=12).

However, an increase in the number of switches increases the cost. In addition, space for installing six switches is necessary at one side of the front cover opening and closing mechanism. The six switches need to be turned on and off by securely linking the switches to the opening and closing of the front cover. Thus, the configuration of the opening and closing mechanism becomes complex, and design of the configuration becomes difficult.

To cope with the above problems, instead of using switches in the opening and closing mechanism, there is also a method of using a relay to interrupt the power supply voltage line of the load system, and interrupting the relay driving circuit with the interlock switch (the front cover switch). In this case, a current up to 20 amperes can be passed using two relays, when one relay has one contact of a rated current 10 amperes. In the case of a machine in which a current of 16 amperes flows, two relays have a function equivalent to that of eight switches. Therefore, an interlock circuit can be prepared using two relays and six switches (4(for laser)+2(for open/close detection)=6).

As a first conventional technique, Japanese Patent Application Laid-open No. H09-212042 discloses a method of suppressing a flowing current so as not to exceed a constant level when the cover is closed, to prevent the occurrence of an inrush current in an input smoothing unit of a drive load unit due to the opening and closing of the cover, thereby preventing a malfunction, and a technique of turning off the converter when the cover is opened and turning on the converter when the cover is closed.

As a second conventional technique, to cancel a timing deviation of contact on/off between interlock switches and prevent malfunction of a machine due to the use of plural interlock switches, Japanese Patent Application Laid-open No. 2002-345148 discloses a technique of using both an interlock switch and a relay, thereby determining an on/off sequence of each power supply system, canceling a timing deviation, and directly stopping generation of a voltage when the interlock switch is off. According to the second conventional technique, the occurrence of an inrush current when an off state of the interlock switch is changed to the on state can be prevented.

However, when the relay contact is closed, an inrush current flows due to a capacitive load provided at the load side, and this inrush current generates an arc and fuses the contact. When the relay contact is fused, the interlock circuit does not function.

To cope with this problem, one approach is to detect an abnormal operation of the interlock circuit before a fusing occurs, thereby preventing the fusing. However, the problem generated by the inrush current is not limited to the fusing of the relay contact. When the inrush current flows to the capacitive load, an overcurrent detecting circuit of a DC power supply circuit can malfunction. When the inrush current occurs, the voltage of the power supply voltage line drops. This causes malfunction of a central processing unit (CPU).

According to the first conventional technique, an inrush current is suppressed using a current limiting unit that limits a current flow to the drive load unit, and a bypassing unit that bypasses the current limiting unit. According to this technique, the circuit becomes complex, and the control of the current limiting unit becomes difficult.

Furthermore, according to the second conventional technique, the interlock is locked and unlocked to match the timings when plural power supply systems are turned on and off. A delay circuit and others are necessary for this purpose. Therefore, the circuit becomes complex, and the cost increases.

SUMMARY OF THE INVENTION

It is an object of the present invention to at least solve the problems in the conventional technology.

According to an aspect of the present invention, an image forming apparatus includes a cover that can be opened or closed, a switch that opens or closes in conjunction with opening or closing of the cover, a load unit that drives the image forming apparatus, a load power supply device that supplies power to the load unit, a relay that passes power from the load power supply device to the load unit by connecting the load power supply device and the load unit in conjunction with opening or closing of the switch, and a controller that detects opening or closing of the switch and controls the load power supply device according to a detection result, wherein when detecting opening of the switch, the controller controls the load power supply device to interrupt supplying power to the load unit until detecting closing of the switch.

According to another aspect of the present invention, a method of controlling power in an image forming apparatus including a cover that can be opened or closed, a switch that opens or closes in conjunction with opening or closing of the cover, a load unit that drives the image forming apparatus, a load power supply device that supplies power to the load unit, includes passing power from the load power supply device to the load unit by connecting the load power supply device and the load unit in conjunction with opening or closing of the switch, detecting opening or closing of the switch, and controlling the load power supply device according to a detection result, wherein when opening of the switch is detected, the load power supply device is controlled to interrupt supplying power to the load unit until closing of the switch is detected.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be described below with reference to accompanying drawings. The present invention is not limited to these embodiments.

Figure 1:
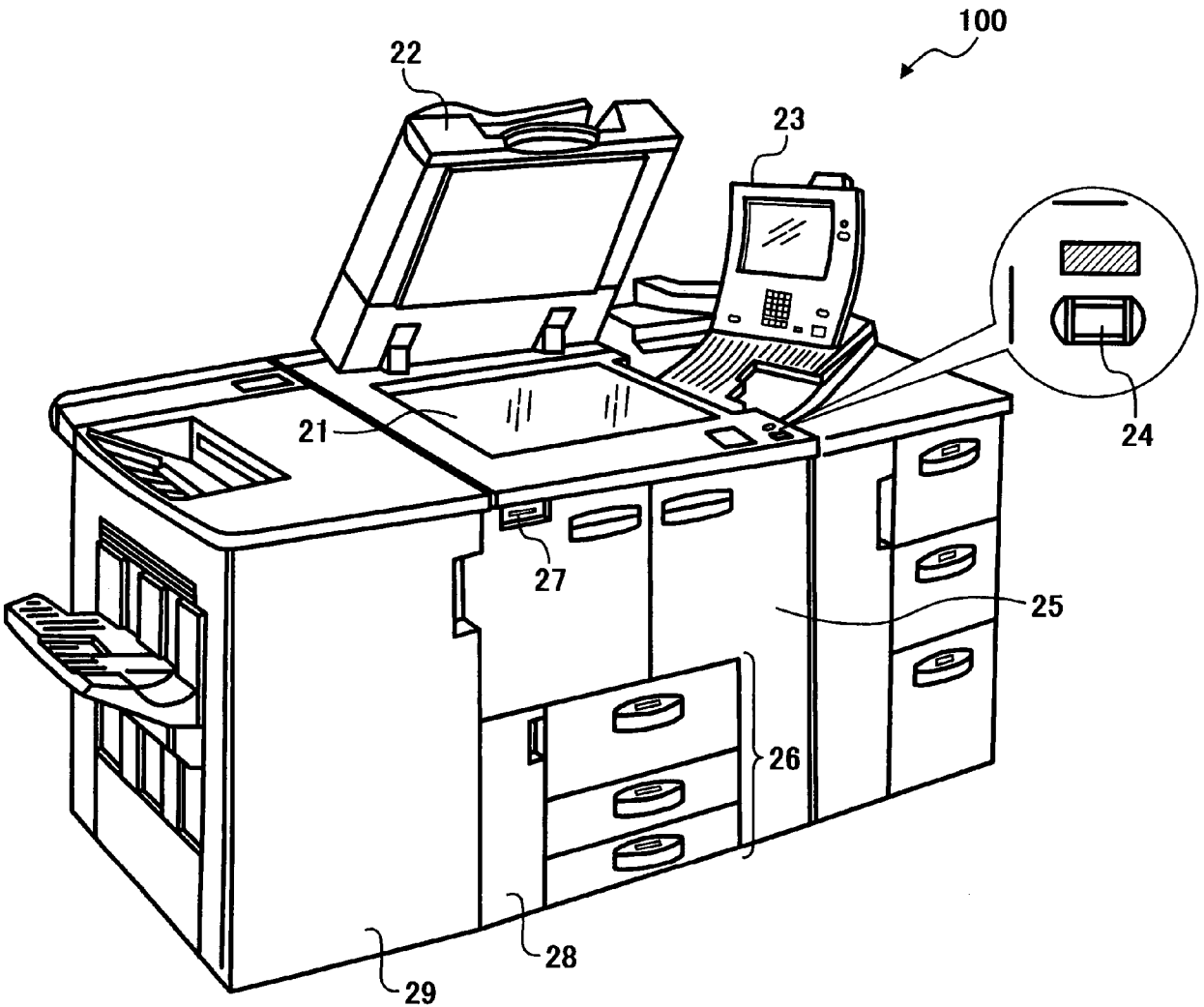
FIG. 1 is a perspective view of an image forming apparatus according to a first embodiment of the present invention.

FIG. 1 is a perspective view of an image forming apparatus 100 according to a first embodiment. The image forming apparatus 100 includes a contact glass 21 on which a document is placed, an automatic document feeder (ADF) 22 that automatically feeds plural pieces of document sequentially onto the contact glass 21, an operating unit 23 from which an operator operates the image forming apparatus 100, a power supply sub-key 24 that switches on and off of a mode clear and preheating, a front cover 25, a paper feed tray 26 for feeding transfer paper, a main power supply switch 27 for switching on and off of the power supply to the entire apparatus, a toner cover 28 that is opened at the time of replenishing a toner, and a finisher 29 that allocates discharge copy paper.

The front cover 25 has the two front doors at the left and the right sides. One interlock switch (not shown) turned on and off and interlocked with the opening and closing of each front door is provided inside of each of the left and the right front doors. In an image forming apparatus with one front door, provision of one switch on the front door is sufficient. Alternatively, to improve safety, two switches can be provided in series on each front door. The image formation processing operation of the image forming apparatus 100 according to the first embodiment is similar to that of a publicly known image forming apparatus. Therefore, explanation thereof is omitted.

Figure 2:
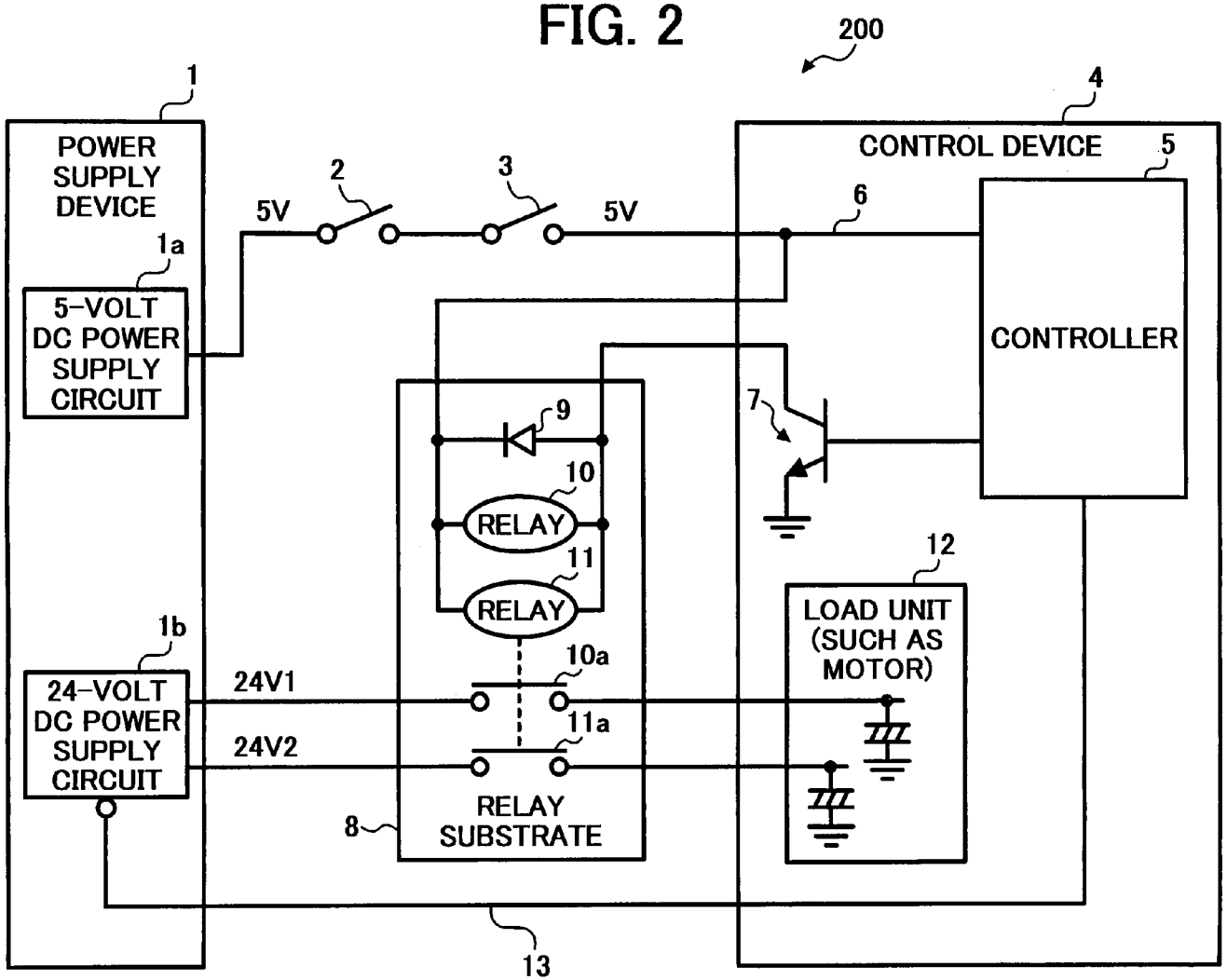
FIG. 2 is a block diagram of an interlock mechanism according to the first embodiment.

FIG. 2 is a block diagram of an interlock mechanism 200 according to the first embodiment. The interlock mechanism 200 includes a power supply device 1 having a 5-volt DC power supply circuit 1*a* and a 24-volt DC power supply circuit 1*b*, door switches (interlock switches) 2 and 3 for opening and closing the circuits interlocked with the opening and closing of the front cover 25, a control device 4 that controls the image forming apparatus 100, relays (interlock relays) 10 and 11 connected to an output of 5 volts of the 5-volt DC power supply circuits 1*a* via the serially connected door switches 2 and 3, and a relay substrate 8 for holding the relays. The relay substrate 8 also holds a diode 9 for suppressing counter electromotive force that occurs at both ends of the relay coils when the relays 10 and 11 are turned off.

The control device 4 includes a transistor (a relay driving unit) 7 that controls the drive of the relays 10 and 11, and a controller 5 that controls the operation of the 24-volt DC power supply circuit 1*b* that supplies power to a load unit 12 such as a motor by detecting the opening or closing of the door switches 2 and 3, and that controls the transistor 7. According to the first embodiment, the door switches 2 and 3 are connected in series, and the relays 10 and 11 are connected in parallel via the door switches 2 and 3. With this arrangement, the 5-volt DC power supply circuit 1*a* drives the relays. Power of two systems of outputs 24-volt 1 and 24-volt 2 of the 24-volt DC power supply circuit 1*b* is individually supplied to the load unit 12 or this power supply is stopped, by closing or opening contacts 10*a* and 11*a*.

Figure 3:
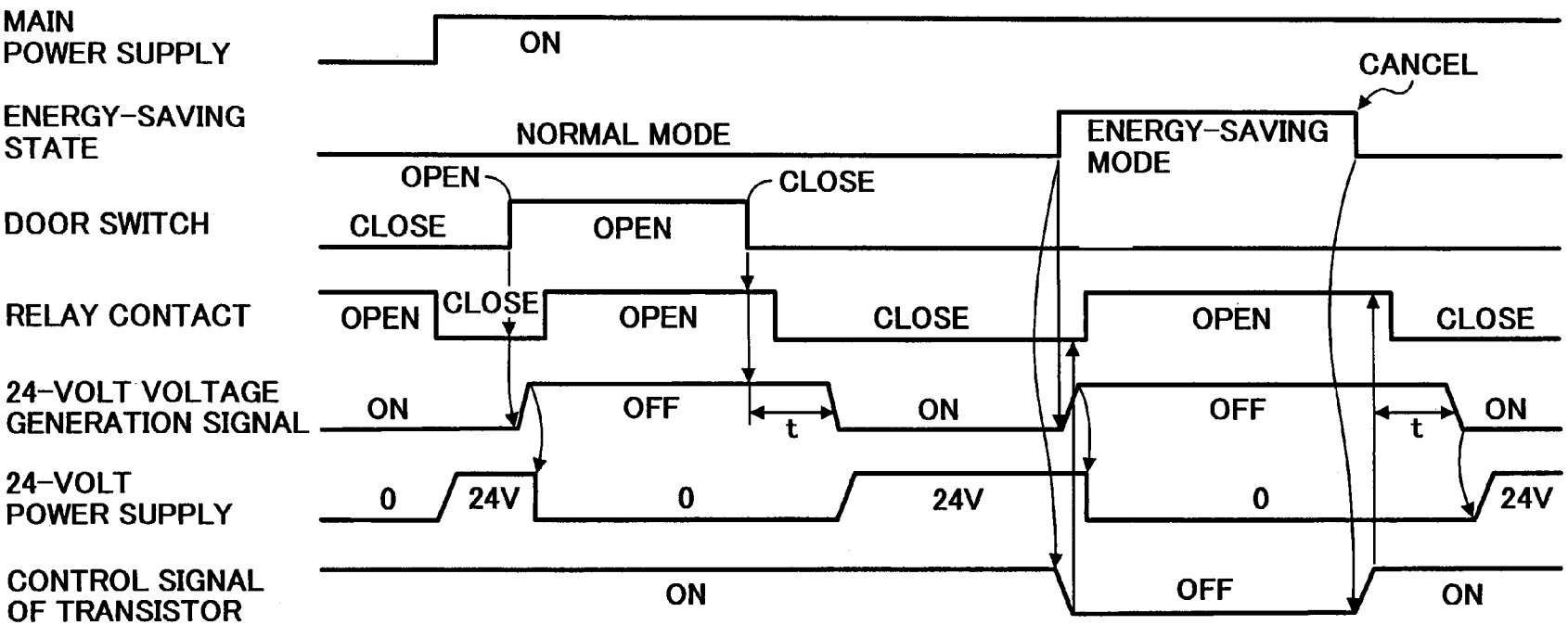
FIG. 3 is a timing chart of an operation of the interlock mechanism according to the first embodiment.

FIG. 3 is a timing chart of the operation of the interlock mechanism 200 in the image forming apparatus 100.

In FIG. 3, the top timing chart shows a state of the main power supply, where a rise of a waveform represents an on state of the power supply, and a fall of the waveform represents an off state of the power supply. The next timing chart shows a signal indicating whether the image forming apparatus 100 is in an energy-saving mode, where a rise represents the energy-saving mode, and a fall represents a normal mode. The next timing chart shows the open or closed state of the door switches 2 and 3, where a rise represents an open state, and a fall represents a closed state. The next timing chart shows states of the contacts 10*a* and 11*a* of the relays 10 and 11, where a rise represents an open state, and a fall represents a closed state. The next timing chart shows a 24-volt voltage generation signal 13 that is output from the controller 5, where a rise represents an off state of generation, and a fall represents an on state of generation. The next timing chart shows a voltage that is output from the 24-volt DC power supply circuit 1*b*, where a rise represents a state that a 24-volt voltage is supplied to the load unit 12, and a fall represents a state that the supply of a 24-volt voltage to the load unit 12 is stopped. The bottom timing chart is a control signal of the transistor 7, where a rise represents an on state, and a fall represents an off state.

Figure 4:
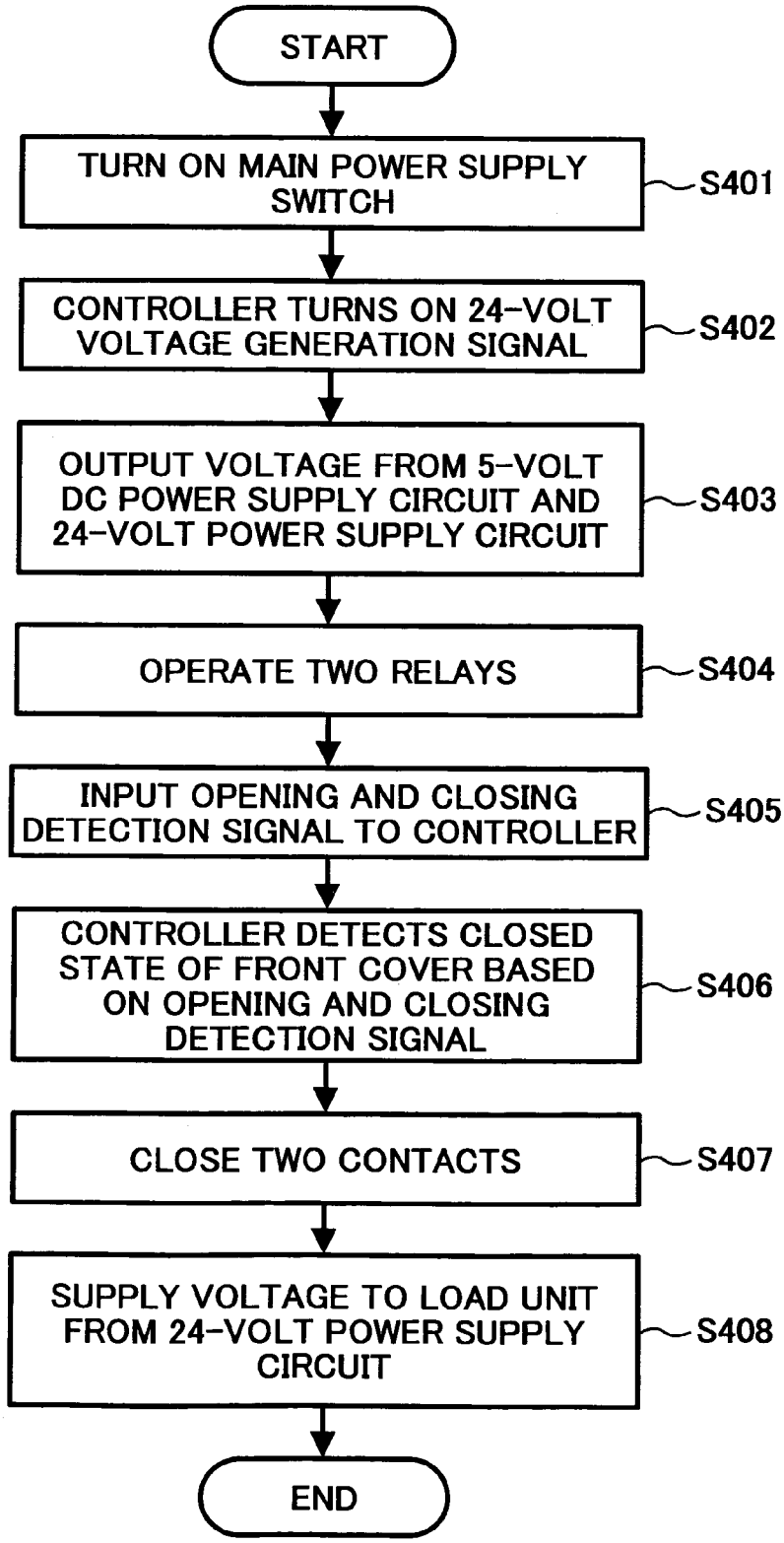
FIG. 4 is a flowchart of an operation procedure performed by the interlock mechanism when a main power supply is turned on in the image forming apparatus according to the first embodiment.

The operation of the interlock mechanism 200 when the main power supply is turned on in the image forming apparatus 100 is explained below with reference to the timing chart in FIG. 3 and a flowchart in FIG. 4. FIG. 4 is the flowchart of an operation procedure performed by the interlock mechanism 200 when the main power supply is turned on in the image forming apparatus 100.

When the main power supply switch 27 is turned on in the normal mode (step S401), the power supply device 1 is driven, and the 5-volt DC power supply circuit 1*a* outputs a voltage, and the 24-volt voltage generation signal 13 is turned on (step S402). Accordingly, the 24-volt DC power supply circuit 1*b* also outputs a voltage (step S403). In this case, when the door switches 2 and 3 are in the closed state, a 5-volt voltage is supplied to the relays 10 and 11, and the relays 10 and 11 are operated simultaneously (step S404). An opening and closing detection signal 6 is input to the controller 5 simultaneously with this operation (step S404). Accordingly, the controller 5 detects that the front cover 25 is closed (step S406).

When the door switches 2 and 3 are opened by serially connecting the door switches 2 and 3 to the power supply device 1 of the relays 10 and 11, the power supply circuit of the relays 10 and 11 is interrupted to stop the operation of the relays 10 and 11. Consequently, power is not supplied to the load unit 12 that is connected to the contacts 10*a* and 11*a*. Accordingly, the open state and the closed state of the door switches 2 and 3 are detected by detecting presence or absence of a voltage in the relays 10 and 11 at step S406.

After the lapse of the operation time of the relays 10 and 11, the contacts 10*a* and 11*a* are closed (step S407), and the voltages 24-volt 1 and 24-volt 2 are supplied to the load unit 12 from the 24-volt DC power supply circuit 1*b* (step S408). This state is the normal mode.

Figure 5:
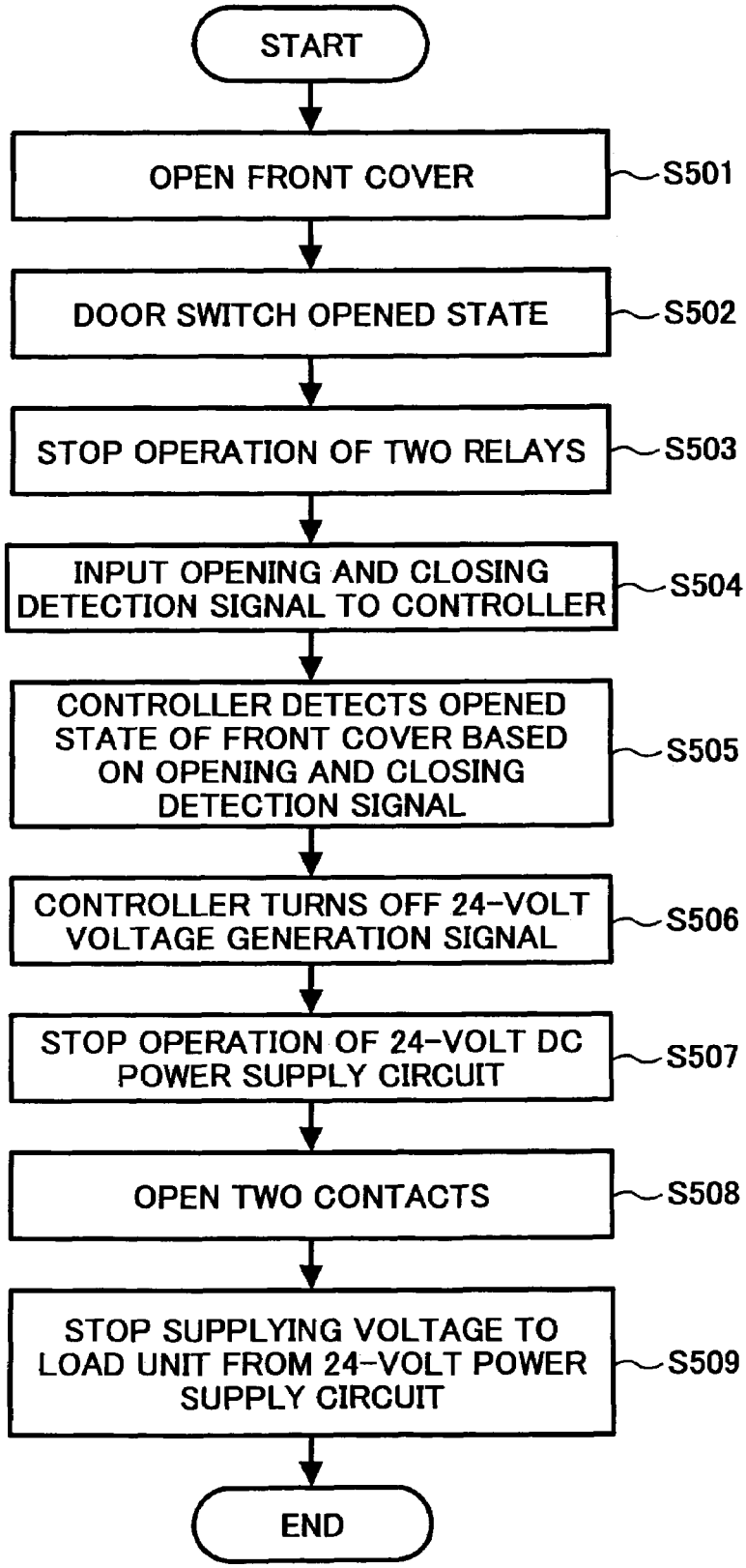
FIG. 5 is a flowchart of an operation procedure performed by the interlock mechanism when an operator opens a front cover.

The operation performed when the operator opens the front cover 25 is explained next. FIG. 5 is a flowchart of an operation procedure performed when the operator opens the front cover 25.

When the operator opens the front cover 25 for a reason (such as a paper jam) (step S501), the door switches 2 and 3 are opened (step S502). Accordingly, the 5-volt power supply to the relays 10 and 11 is interrupted, and the operation of the relays 10 and 11 is stopped (step S503). Simultaneously with the stop of operation, the opening and closing detection signal 6 is input to the controller 5 (step S504). Consequently, the controller 5 detects that the front cover 25 is opened (step S505). As a result, the controller 5 turns off the 24-volt voltage generation signal 13 (step S506), and stops the operation of the 24-volt DC power supply circuit 1*b* (step S507). After the lapse of the operation stop time of the relays 10 and 11, the contacts 10*a* and 11*a* are opened (step S508), and the supply of the voltage 24-volt 1 and 24-volt 2 from the 24-volt DC power supply circuit 1*b* to the load unit 12 is stopped (step S509). This state is called the interlock state, in which the operator is protected from danger when the front cover is open.

As explained above, the image forming apparatus 100 includes the relays 10 and 11 that supply power to the load unit 12 or stop the power supply to the load unit 12 linked to the opening and closing of the door switches 2 and 3. When the controller 5 detects that the door switches 2 and 3 are opened, the controller 5 controls the 24-volt DC power supply circuit 1*b*, thereby stopping the power supply to the load unit 12. In other words, the image forming apparatus 100 interrupts power supply to the load unit 12 to prepare for a release state of the interlock (described later). With this arrangement, the occurrence of the inrush current when power is supplied in the closed state of the door switches 2 and 3 can be suppressed.

Figure 6:
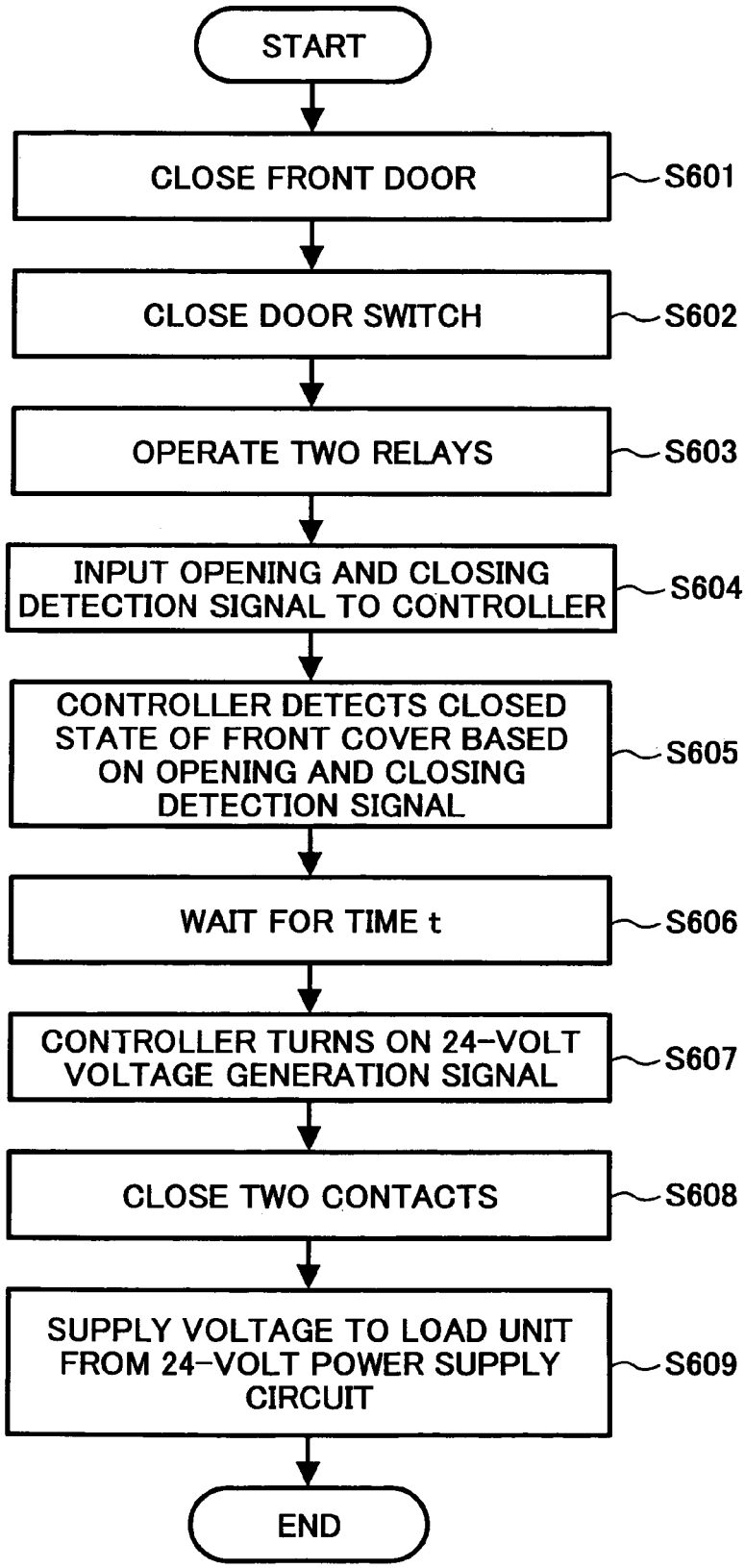
FIG. 6 is a flowchart of an operation procedure performed by the interlock mechanism when the operator closes the front cover.

The operation of the interlock mechanism when the operator closes the front cover 25 is explained next. FIG. 6 is a flowchart of an operation procedure performed by the interlock mechanism 200 when the operator closes the front cover 25.

When the operator closes the front cover 25 after solving a problem (such as a paper jam) (step S601), the door switches 2 and 3 are closed (step S602). Accordingly, the 5-volt power supply to the relays 10 and 11 is connected, and the operation of the relays 10 and 11 is started (step S603). Simultaneously with the start of the operation, the opening and closing detection signal 6 is input to the controller 5 (step S604). Consequently, the controller 5 detects that the front cover 25 is closed (step S605). In this case, while the relays 10 and 11 operate, the contacts 10*a* and 11*a* are not yet closed due to a mechanical delay. Therefore, the controller 5 waits for a predetermined time (t) (step S605). After the lapse of the time t, the controller 5 turns on the 24-volt voltage generation signal 13, and makes the 24-volt DC power supply circuit 1*b* operative (step S607).

According to the first embodiment, a 24-volt voltage generation command signal is set on 50 microseconds after the closing of the front cover 25 is detected. The time difference of 50 microseconds is provided because 10 microseconds to 20 microseconds are required for the relay contact to be actually closed since the driving (coil) voltage is turned on, due to the power of the relays.

Figure 7:
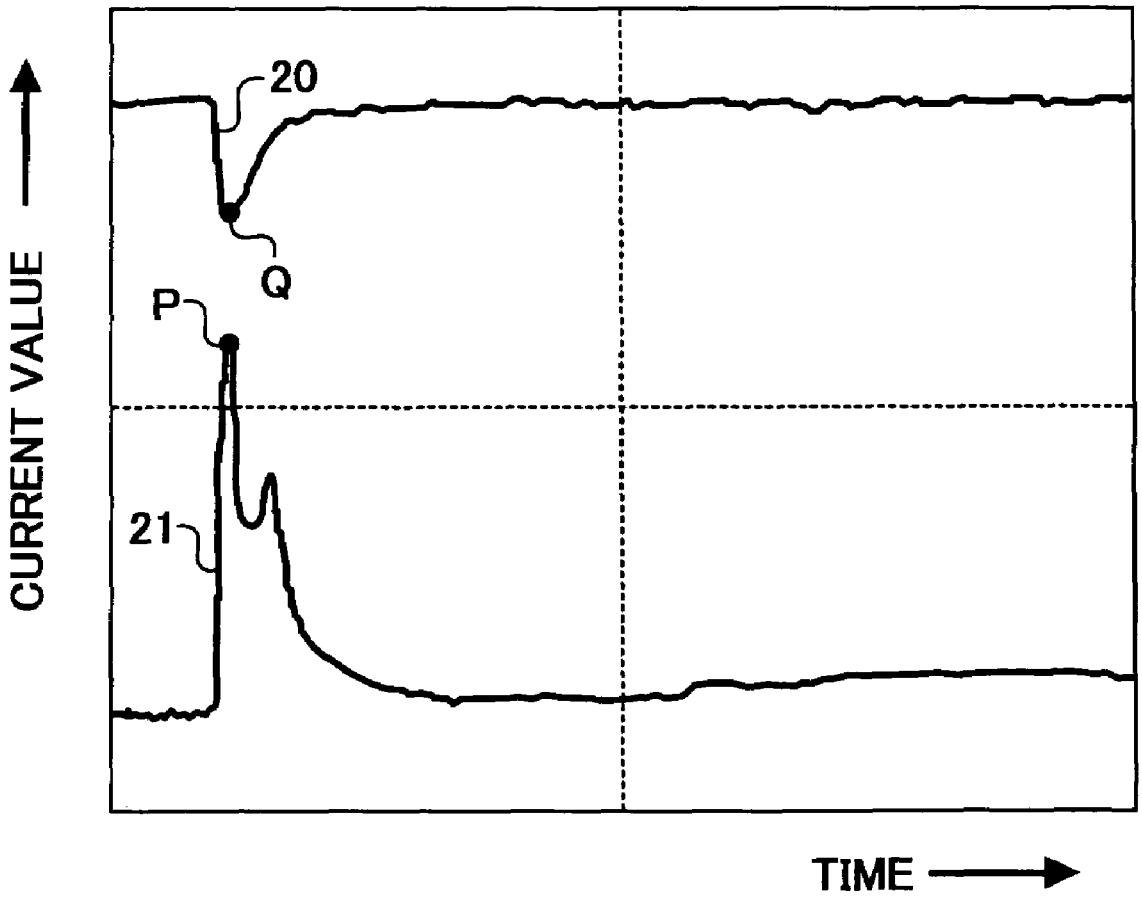
FIG. 7 depicts a change of a surge current and an output voltage.

After the process at step S607, the contacts 10*a* and 11*a* of the relays 10 and 11 are closed (step S608). Thereafter, the voltages 24-volt 1 and 24-volt 2 are supplied to the load unit 12 from the 24-volt DC power supply circuit 1*b* (step S609). This state is called an interlock release state. Thereafter, the control device 4 checks whether the cause of stopping the apparatus is removed. After the cause of the problem is removed, the apparatus returns to the normal mode. When the contacts 10*a* and 11*a* of the relays 10 and 11 are closed while the 24-volt DC power supply circuit 1*b* is operating, a surge current 21 flows as shown in FIG. 7, when the load unit is a capacitive load. As a result, a 5-volt output voltage 20 of the power supply device 1 falls, and this has a risk of disturbing the operation of the controller 5. Moreover, a large current flows to the contacts 10*a* and 11*a*, and this has a risk of fusing the contacts.

The operation of the interlock mechanism 200 in the energy-saving mode of the image forming apparatus 100 is explained next. The image forming apparatus 100 has the energy-saving mode of keeping unnecessary load such as a heater and a power supply in the off state, to suppress power consumption in the waiting state. First, the operation of the interlock mechanism when the operation mode shifts to the energy-saving mode is explained with reference to FIGS. 3 and 8.

Figure 8:
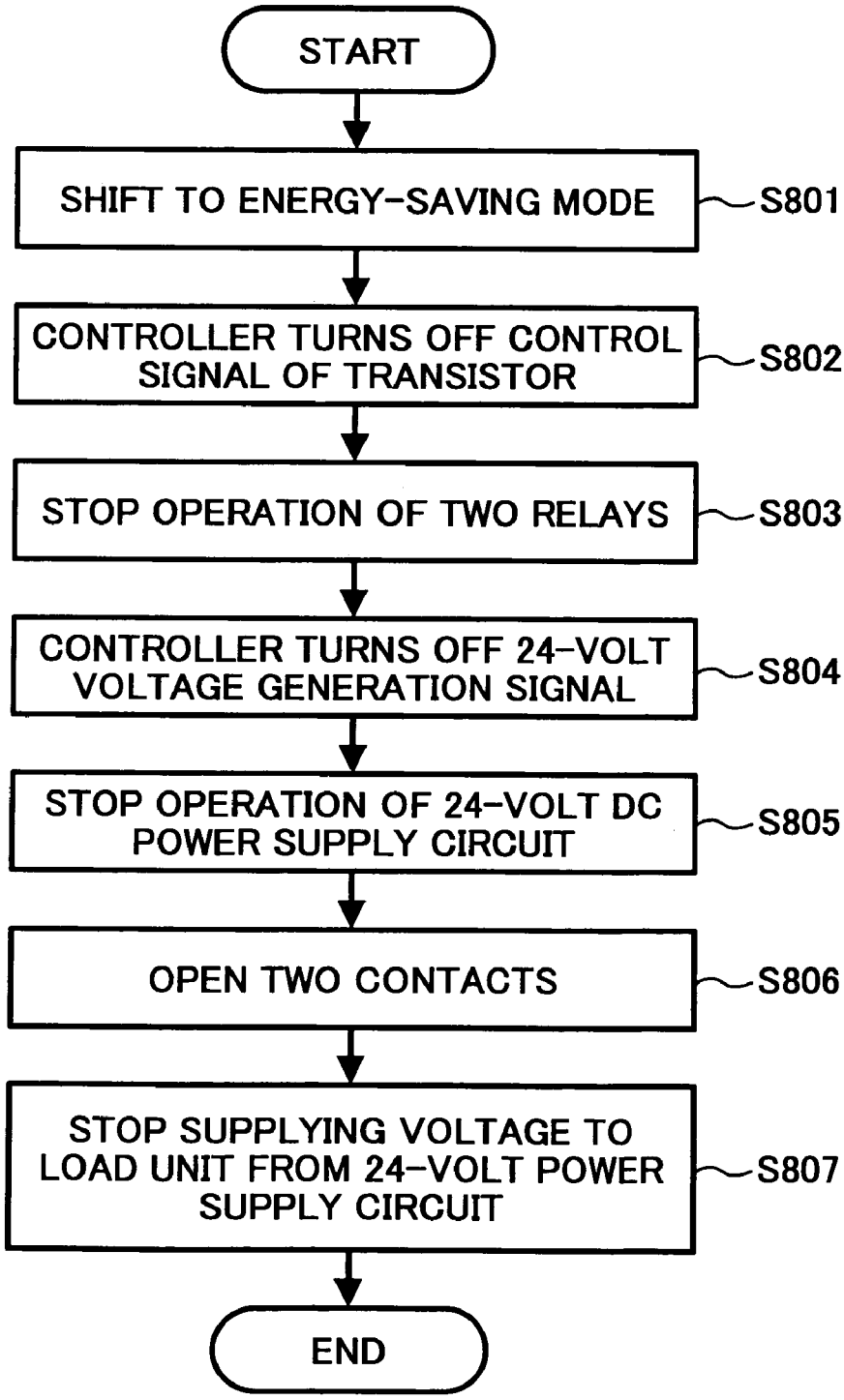
FIG. 8 is a flowchart of an operation procedure performed by the interlock mechanism when the image forming apparatus according to the first embodiment shifts to an energy-saving mode.

FIG. 8 is a flowchart of a process procedure performed by the interlock mechanism 200 when the image forming apparatus 100 shifts to the energy-saving mode. When the control device 4 shifts to the energy-saving mode by satisfying a condition for shifting to the energy-saving mode (such as the apparatus is not operated after a predetermined time) (step S801), the controller 5 turns off the control signal of the transistor 7 (step S802), and stops the operation of the relays 10 and 11 (step S803). Accordingly, while the 5-volt DC power supply circuit 1*a* operates, no current flows to the relays 10 and 11. Therefore, power consumption by the load can be reduced. At the same time, the controller 5 turns off the 24-volt voltage generation signal 13 (step S804), and stops the operation of the 24-volt DC power supply circuit 1*b* (step S805). As the operation of the relays 10 and 11 stops, the contacts 10*a* and 11*a* of the relays 10 and 11 are opened (step S806), and the 24-volt DC power supply circuit 1*b* stops supplying a voltage, thereby further increasing the energy-saving effect. Operation of either the relays 10 and 11 or the 24-volt DC power supply circuit 1*b* can be stopped separately, or both the relays 10 and 11 and the 24-volt DC power supply circuit 1*b* can be stopped at the same time.

Figure 9:
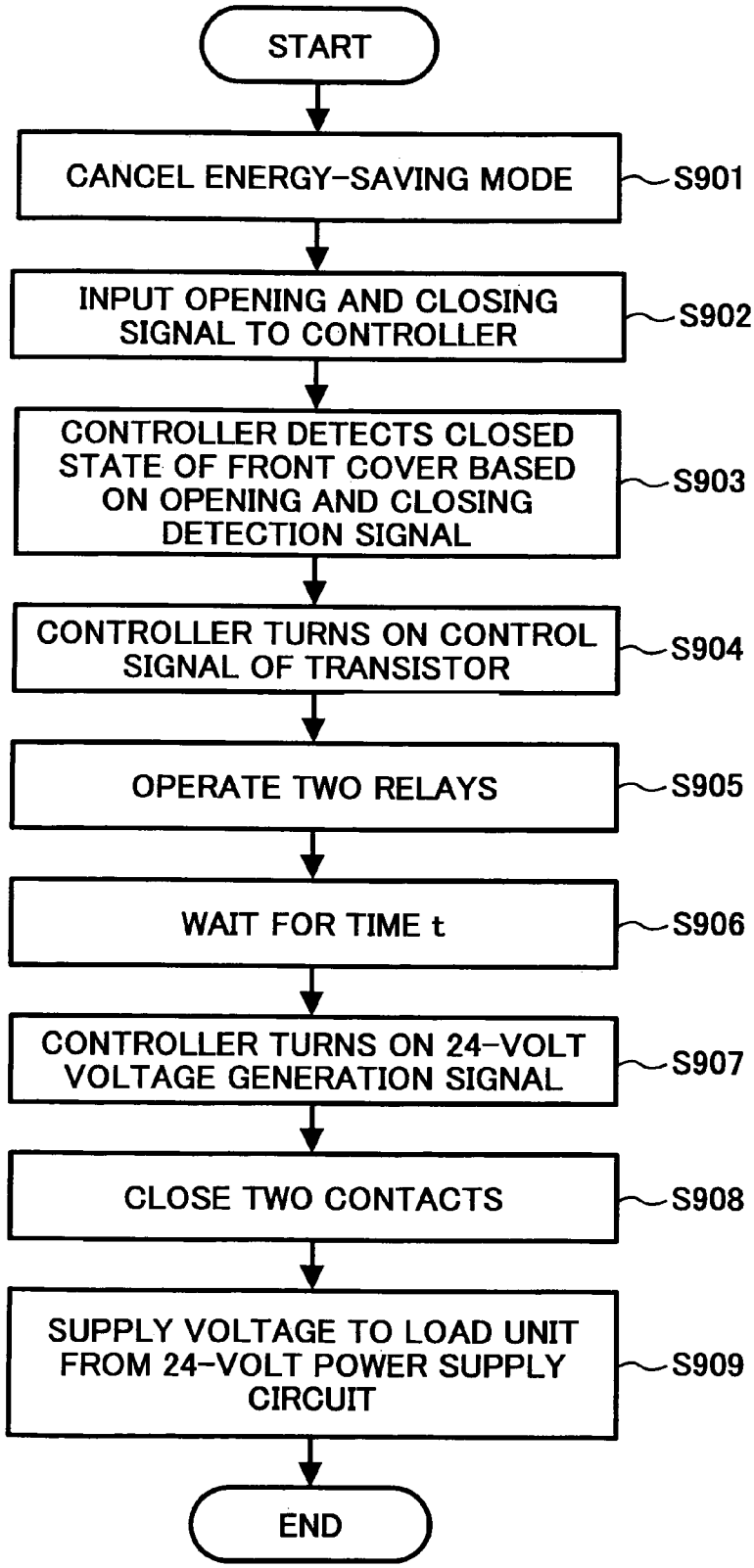
FIG. 9 is a flowchart of an operation procedure performed by the interlock mechanism when the energy-saving mode of the image forming apparatus according to the first embodiment is canceled.

The operation performed by the interlock mechanism 200 when the energy-saving mode is canceled is explained next with reference to FIGS. 3 and 9. FIG. 9 is a flowchart of an operation procedure performed by the interlock mechanism 200 when the energy-saving mode is canceled.

When the operator instructs the operation of setting a document to the ADF, the energy-saving mode of the control device 4 is canceled (step S901). At this time, an opening and closing detection signal is input to the controller 5 (step S902), and the controller 5 detects that the door switches 2 and 3 are in the closed state (step S903). The controller 5 sets the control signal of the transistor 7 to on (step S904), thereby making the relays 10 and 11 operative (step S905). While the relays 10 and 11 operate, the contacts 10*a* and 11*a* are not yet closed due to a mechanical delay. Therefore, the controller 5 waits for a predetermined time (t) (step S906). After a lapse of the time t, the controller 5 turns on the 24-volt voltage generation signal 13 (step S907), and makes the 24-volt DC power supply circuit 1*b* operative. Accordingly, after the contacts 10*a* and 11*a* of the relays 10 and 11 are closed (step S908), the 24-volt DC power supply circuit 1*b* supplies the voltages 24-volt 1 and 24-volt 2 to the load unit 12 (step S909). Consequently, the occurrence of an unexpected state due to the surge current can be prevented.

While the two relays 10 and 11, and the two contacts 10*a* and 11*a* corrected to these relays are provided in the first embodiment, the configuration is not limited to this. A signal relay and a single contact can be also provided corresponding to the configuration of the power supply device 1. Alternatively, three or more relays, and three or more contacts can be provided.

Figure 10:
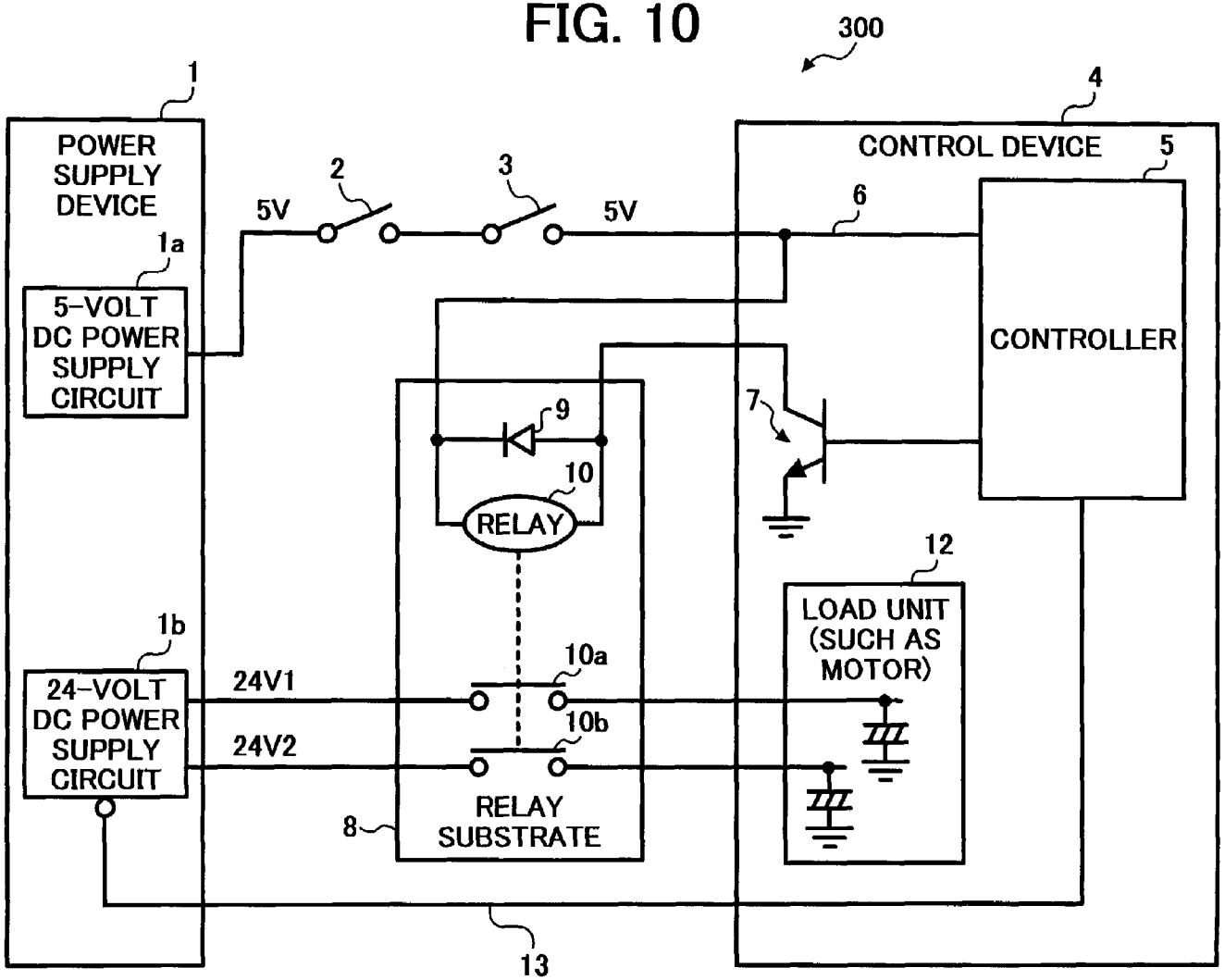
FIG. 10 is a block diagram of an interlock mechanism according to a second embodiment of the present invention.

An interlock mechanism 300 of an image forming apparatus according to a second embodiment is explained next. FIG. 10 is a block diagram of the configuration of the interlock mechanism 300 according to the second embodiment. Constituent elements similar to those shown in FIG. 2 are designated with like reference numerals.

The interlock mechanism 300 according to the second embodiment is different from that according to the first embodiment shown in FIG. 2 in that the contacts 10*a* and 11*a* of two circuits are connected to one relay 10, as shown in FIG. 10. In other words, the relay 10 has the contacts 10*a* and 11*a* of the two circuits. The 24-volt DC power supply circuit 1*b* supplies the voltages 24-volt 1 and 24-volt 2 to each contact to the load unit 12.

As explained above, when the relay having the contacts of the two circuits is used, the configuration can be made small. Moreover, the power supply capacity of the 5-volt DC power supply circuit 1*a* can be made small.

In general, whether the relay having contacts of two circuits is to be used is determined based on the size of the load current that flows to the contacts. Other operations of the interlock mechanism 300 are similar to those of the interlock mechanism 200 according to the first embodiment explained with reference to FIGS. 3 to 9, and therefore, their explanation is omitted.

Figure 11:
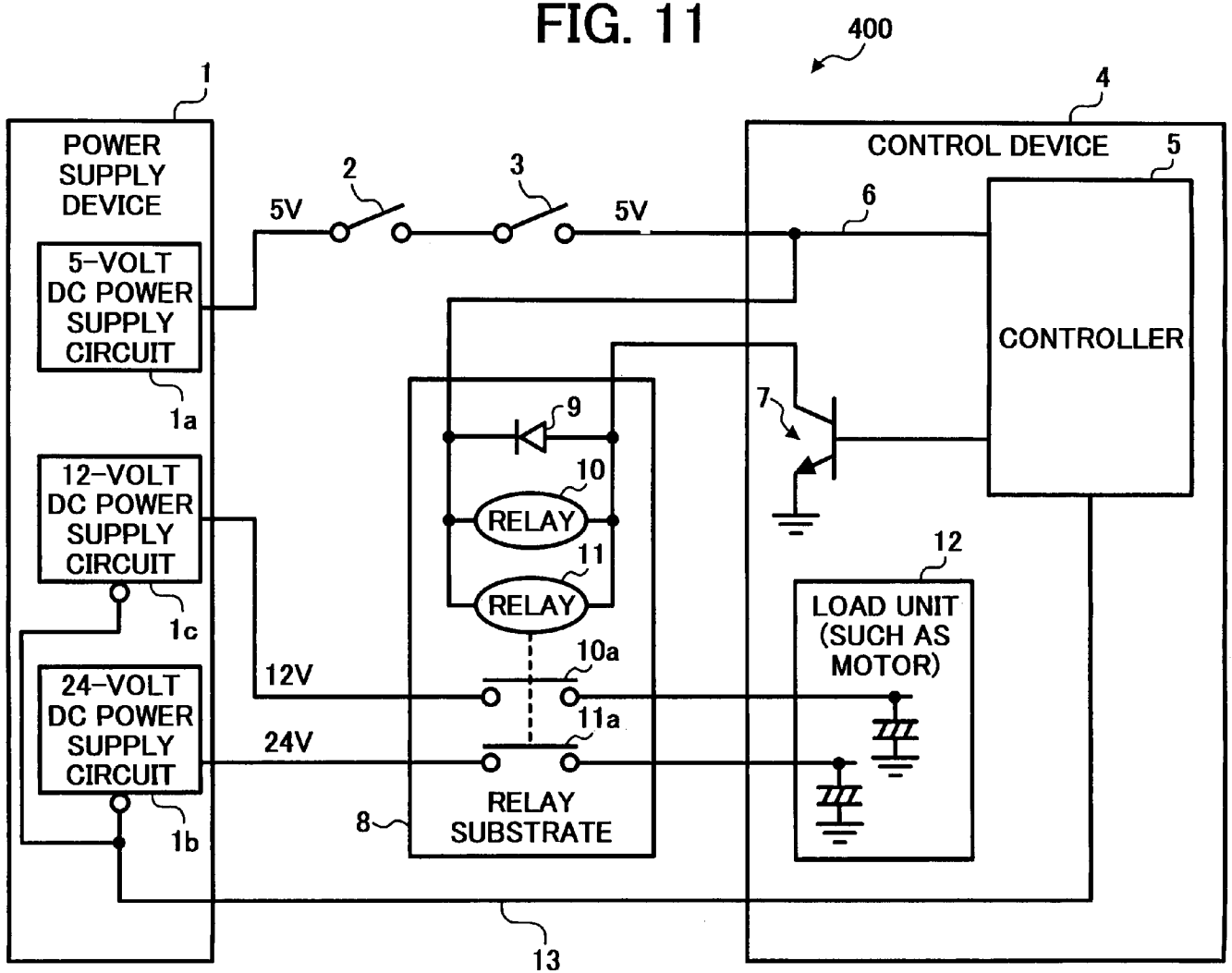
FIG. 11 is a block diagram of an interlock mechanism according to a third embodiment of the present invention.

An interlock mechanism 400 of an image forming apparatus according to a third embodiment is explained next. FIG. 11 is a block diagram of the configuration of the interlock mechanism 400 according to the third embodiment. Constituent elements similar to those shown in FIG. 2 are designated with like reference numerals.

The interlock mechanism 400 according to the third embodiment is different from that according to the first embodiment shown in FIG. 2 in that a power supply having a voltage different from that of other power supply is separately connected to the contact of each relay as shown in FIG. 11. In other words, a 12-volt DC power supply circuit 1*c* is additionally provided in the power supply device 1. With this arrangement, the 12-volt DC power supply circuit 1*c* supplies a voltage of 12 volts to the contact 10*a*, and the 24-volt DC power supply circuit 1*b* supplies a voltage of 24 volts to the contact 11*a* to the load unit 12.

As explained above, when contacts of two circuits are used, different voltages can be securely separated. The controller 5 simultaneously controls the 12-volt DC power supply circuit 1*c* and the 24-volt DC power supply circuit 1*b* based on the voltage generation signal 13. Other operations of the interlock mechanism are similar to those of the interlock mechanism 200 according to the first embodiment explained with reference to FIGS. 3 to 9, and therefore, their explanation is omitted.

In the third embodiment, while the controller 5 simultaneously operates the relays 10 and 11 with the transistor 7, a transistor circuit can be additionally provided, and each transistor can individually control the relays 10 and 11. Alternatively, contacts of two relays can be used for one relay, thereby decreasing one relay, when the two circuits can operate simultaneously. Although a configuration has been explained in which the controller 5 simultaneously controls the 12-volt DC power supply circuit 1*c* and the 24-volt DC power supply circuit 1*b* based on the voltage generation signal 13, it is possible to employ a configuration in which the controller 5 controls the DC power supply circuits at different timings.

According to the first to the third embodiments, immediately after the 24-volt voltage generation signal is switched from off to on, the 24-volt DC power supply circuit 1*c* supplies a voltage to the load unit 12, thereby controlling the load unit. Alternatively, after the 24-volt voltage generation signal is switched from off to on, the 24-volt DC power supply circuit 1*c* can start supplying a voltage to the load unit 12 after a lapse of a constant time (for example, 100 microseconds) thereby controlling the load unit. When the control is to be started after a lapse of a constant time, this is effective when it takes a several tens of microseconds for the output voltage to rise to 24 volts (or 38 volts) since the 24-volt voltage generation signal is switched from off to on. To start the control after a lapse of a constant time like this, the time required for the output voltage to rise is measured in advance, and the supply of voltage to the load unit 12 is started after a lapse of the constant time by a timer management of software. Alternatively, the load unit 12 can detect the output voltage, and the control can be started after confirming the rise of the output voltage.

According to the present invention, power supply can be easily controlled without requiring a complicated circuit or excessive circuits so that space and cost can be saved.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a cover configured to open or close;

an interlock switch configured to open or close in conjunction with opening or closing of the cover;

a power supply device configured to generate a predetermined voltage for supplying power to a load unit;

an interlock relay configured to open or close a contact disposed on a power supply line between the power supply device and the load unit by connecting the power supply device and the load unit in conjunction with opening or closing of the switch; and a controller configured to detect opening or closing of the interlock switch and to control the power supply device according to a detection result, wherein when detecting opening of the interlock switch, the controller controls the power supply device to stop generating the predetermined voltage by turning off the power supply device, and the controller controls the power supply device to resume generating the predetermined voltage after detecting closing of the interlock switch.

2. The image forming apparatus according to claim 1, further comprising a relay power supply device that supplies power to the interlock relay, wherein the controller detects opening or closing of the cover based on an output voltage of the relay power supply device.

3. The image forming apparatus according to claim 1, wherein when the controller detects closing of the cover, the controller controls the power supply device to generate the predetermined voltage after lapse of a predetermined time.

4. The image forming apparatus according to claim 3, wherein the predetermined time is equal to or longer than a time required for the relay to complete connecting the power supply device and the load unit.

5. The image forming apparatus according to claim 1, wherein the controller further includes a relay driving unit that drives the relay, and when the image forming apparatus shifts to an energy-saving mode, the controller controls the relay driving unit to stop driving the relay.

6. The image forming apparatus according to claim 5, wherein when the image forming apparatus shifts to the energy-saving mode, the controller controls the power supply device to stop generating the predetermined voltage until the energy-saving mode is canceled.

7. The image forming apparatus according to claim 6, wherein when the energy-saving mode is canceled, the controller controls the power supply device to start generating the predetermined voltage after lapse of a predetermined time.

8. The image forming apparatus according to claim 1, including a plurality of the relays.

9. The image forming apparatus according to claim 8, wherein each of the relays includes a relay contact to connect and disconnect the power supply device and the load unit.

10. The image forming apparatus according to claim 9, including a plurality of the power supply devices, wherein each of the relay contacts is connected to a different power supply device.

11. The image forming apparatus according to claim 10, wherein each of the power supply devices has a different voltage.

12. The image forming apparatus according to claim 1, wherein the relay is a single relay including a plurality of relay contacts to connect and disconnect the power supply device and the load unit.

13. An image forming apparatus including a cover that can be opened or closed and a switch that opens or closes in conjunction with opening or closing of the cover, comprising:

a driving means for driving the image forming apparatus;

a power supplying means for generating a predetermined voltage for supplying power to the driving means;

a relaying means for passing power from the power supplying means to the driving means by connecting the power supplying means and the driving means in conjunction with opening or closing of the switch; and a controlling means for detecting opening or closing of the cover and controlling the power supplying means according to a detection result, wherein when detecting opening of the cover, the controlling means controls the power supplying means to stop generating the predetermined voltage by turning off the power supplying means until detecting closing of the cover.

14. A method of controlling power in an image forming apparatus including:

a cover configured to open or close;

an interlock switch configured to open or close in conjunction with opening or closing of the cover;

a power supply device configured to generate a predetermined voltage for supplying power to a load unit, the method comprising:

passing power from the power supply device to the load unit by connecting the power supply device and the load unit in conjunction with opening or closing of the switch;

detecting opening or closing of the interlock switch; and controlling the power supply device according to a detection result, wherein when opening of the switch is detected, the power supply device is controlled to stop generating the predetermined voltage by turning off the power supply device until closing of the switch is detected.

15. The method according to claim 14, wherein the image forming apparatus further includes a relay power supply device that supplies power to the relay, and opening or closing of the cover is detected based on an output voltage of the relay power supply device.

16. The method according to claim 14, wherein when closing of the cover is detected, the power supply device is controlled to resume generating the predetermined voltage after lapse of a predetermined time.

17. The method according to claim 16, wherein the predetermined time is equal to or longer than a time required for the power supply device to be connected to the load unit.

18. The method according to claim 14, wherein the controlling further includes driving the connecting of the power supply device and the load unit, and when the image forming apparatus shifts to an energy-saving mode, the driving is stopped.

19. The method according to claim 18, wherein when the image forming apparatus shifts to the energy-saving mode, the power supply device is controlled to stop generating the predetermined voltage until the energy-saving mode is canceled.

20. The method according to claim 19, wherein when the energy-saving mode is canceled, the power supply device is controlled to start supplying power to the load unit after lapse of a predetermined time.

* * * * *